United States Patent [19]

Vandas

[11] 4,029,002

[45] June 14, 1977

[54] KITCHEN VENTILATOR DAMPER CONSTRUCTION

[75] Inventor: Edward B. Vandas, St. Louis, Mo.

[73] Assignee: McGraw-Edison Company, Elgin, Ill.

[22] Filed: Dec. 8, 1975

[21] Appl. No.: 638,502

[52] U.S. Cl. ..... 98/115 K; 98/121 A; 126/299 B; 126/285 R; 308/30; 308/34

[51] Int. Cl.[2] ..... F23J 11/00

[58] Field of Search ..... 98/115 K, 110, 121 R, 98/121 A; 137/601; 308/21, 27, 30, 34; 126/299 R, 299 B, 285 R; 248/264, 268

[56] References Cited

UNITED STATES PATENTS

| | | | |
|---|---|---|---|
| 1,748,734 | 2/1930 | Schroyer | 248/268 |
| 3,055,285 | 9/1962 | Gaylord | 98/115 K |
| 3,084,715 | 4/1963 | Sharres | 137/601 |
| 3,216,691 | 11/1965 | Fradin | 248/268 |

*Primary Examiner*—Ronald C. Capossela
*Attorney, Agent, or Firm*—Charles F. Lind

[57] ABSTRACT

A kitchen ventilating system typically has an exhaust duct and power fan means therein which communicates through passage means with an inlet located in the kitchen. This disclosure teaches particular means for mounting a damper so that it can be pivoted to open and close the passage means, and further can be easily installed and removed from the passage means. The damper pivot means include stub shafts that project beyond the end edges of the damper and thin plate bearing means that receive and journal the respective stub shafts, where the bearing means can be releasably secured relative to the passage means wall structure.

2 Claims, 4 Drawing Figures

FIG. 1
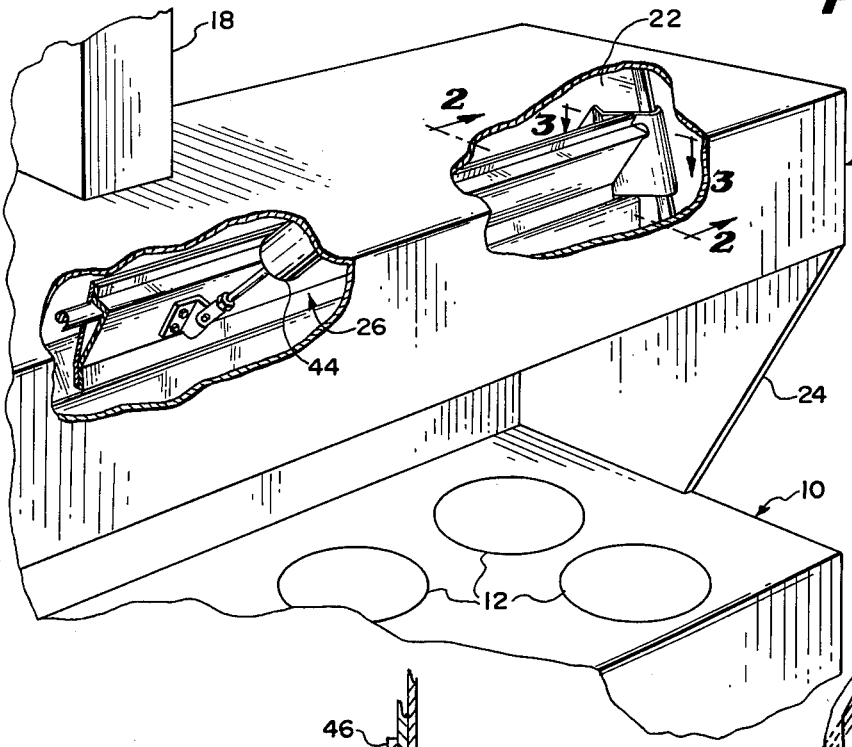
FIG. 2
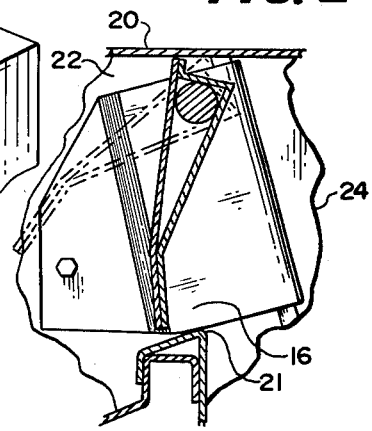
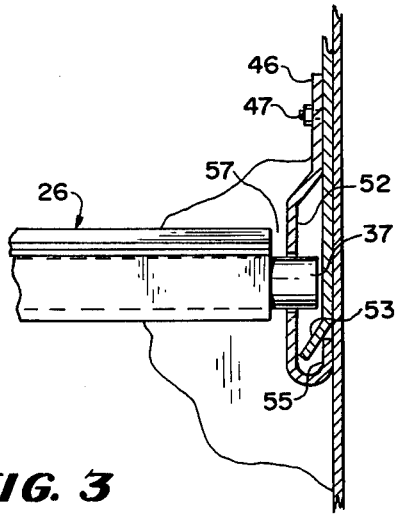
FIG. 3
FIG. 4
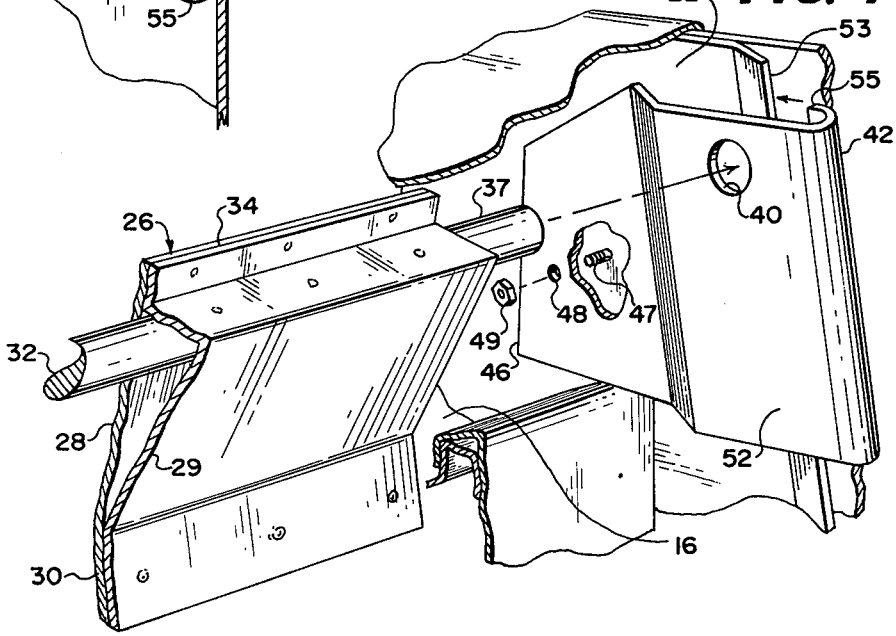

KITCHEN VENTILATOR DAMPER CONSTRUCTION

Background of the Invention

A ventilating system for a commercial kitchen typically includes a hood located over the cooking equipment and passage structure from the hood that leads to an exhaust duct that discharges to the outside atmosphere, and a blower or fan draws the kitchen fumes through the exhaust duct for discharge to the outside atmosphere. The system removes heat, grease, and odors from the kitchen and greatly improves the comfort factor of the employees as well as the patrons.

The ventillating system further typically has a damper which can close the flow passage between the kitchen and the exhaust duct, and this is used during a kitchen fire to prevent the flame from being carried up the exhaust duct. This helps smother the fire and further minimizes the possibility of having a fire in the exhaust duct. However, a kitchen fire proximate the hood structure an heat and warp the damper, so that service of it sometimes is necessary; but more frequently, service of water spray equipment located inside the duct work is required even on a routine basis and access to such equipment is thus required.

Several patents which relate to the general type hood construction to which this application pertains and over which the invention forms an improvement are the Gaylord U.S. Pat. No. 2,813,477 entitled Safety Ventilator Unit; the Graswich et al. U.S. Pat. No. 2,961,941 entitled Grease Extracting Attachment for Ventilators for Kitchen Ranges; the Gaylord U.S. Pat. No. 3,055,285 entitled Kitchen Ventilating System; the Gaylord U.S. Pat. No. 3,207,058 entitled Kitchen Ventilating system; The Gaylord U.S. Pat. No. 3,247,776 entitled Kitchen Ventilating system; The Gaylord U.S. Pat. No. 3,611,908 entitled Fail-Safe Damper Control for Kitchen Ventilator; and the Gaylord U.S. Pat. No. 3,785,124 entitled Pollution-Free Kitchen Ventilator.

SUMMARY OF THE INVENTION

This invention relates to a kitchen ventilating system having an exhaust duct that communicates through internal passage means with a kitchen inlet, and further to a removable damper for selectively closing and opening the inlet. The invention specifically provides for removable means for pivotally supporting the damper in place, and includes stub shafts projecting beyond the end edges of the damper and bearing plates that are held in place against the inlet structure by releasable screw means and that have openings to receive and support the stub shafts. Each bearing plate is relatively thin, but is shaped to have laterally offset end portions, and the plate opening for receiving and journalling the stub shaft is spaced from the end portions. The offset end portions of the plates abut the inlet side walls and thereby maintain the plates at the shaft opening spaced from the wall structure. Further, one laterally offset end portion is folded over almost on itself to define a lip, and this lip overlies and covers the free end edge of the inlet structure side wall, and this locates the plate and simplifies the means for removably, but securely mounting the bearing plate in place.

BRIEF DESCRIPTION OF THE DRAWINGS

FIG. 1 is a view of a typical ventilating hood structure shown in operative association with a cooking appliance for a commercial kitchen, and showing a preferred embodiment of the subject damper construction;

FIG. 2 is a sectional view as seen generally from line 2—2 in FIG. 1, showing the inlet opening from the kitchen to the venting hood and the damper in operative association therewith;

FIG. 3 is a sectional view as seen generally from line 2—2 in FIG. 1, showing specific mounting means for the damper; and FIG. 4 is an exploded perspective view showing the important components used in the damper mounting invention shown in the previous figures.

DETAILED DESCRIPTION OF THE INVENTION

In FIG. 1, a range 10 having burners 12 is shown, and a vent hood 14 is shown overlying the range as might be typical in a commercial kitchen. The hood has wall structures which define an inlet opening 16 that communicates through internal grease extraction passageways (not shown) within the hood structure ultimately with an exhaust duct 18, and the exhaust duct conventionally extends through the side wall or ceiling of the kitchen to an atmosphere outside the kitchen, typically to the out of doors. In normal use, there further would be a powered ventilating means (not shown) near the end of the outside exhaust duct which would create a negative pressure in the duct to draw air from the kitchen into and through the hood inlet opening 16 for discharge to outside the kitchen.

The particular invention taught herein is the means for mounting a damper in operative arrangement within the inlet opening 16 of the hood 14.

It will be noted that the inlet opening 16 is actually defined by spaced horizontal walls 20 and 21 of the hood structure, and by a pair of opposing vertical side walls 22 which interconnect the top wall 20 and the lower wall 21. The inlet opening is of a rectangular configuration.

In the disclosure herein, the hood actually has the vertical inner side walls 22 previously noted, and of a pair of outer vertical side walls 24 which project beyond the inner side walls 22; and the inner side walls generally terminate approximately at, but slightly forward or upstream of the inlet opening 16.

A damper 26 of rectangular configuration slightly smaller than the inlet opening 16 is supported within the inlet opening. The damper is formed of a pair of plates 28 and 29 which are lapped and spot welded together at corresponding ends as at 30, and the opposite ends of the plates are formed around and spotted to a rod 32 and lapped again and spot welded together at seam 34. The rod 32 actually extends completely through the damper and thus along with the cornered bends on the various plates 28 and 29 gives lateral ridgidity to the damper assembly. The opposite ends of the rod 32 project beyond the end edges of the damper and thus define opposing stub shafts 37 (only one of which is shown). The lateral extent of the stub shafts is less than the full width of the inlet openings and thus the damper assembly fits within the vent side walls 22.

As noted in FIGS. 3 and 4, the stub shaft 37 fits within an opening 40 in a bearing mount 42, and the bearing mount in turn is held fast against the hood wall 22. This supports the damper for pivotal movement relative to the inlet opening between a closed position shown in FIG. 2 and an opened position (shown in phantom in FIG. 2). An actuating device 44 connected between the damper and the hood structure is used for shifting under power the damper between the opened and closed positions. Specific details of the means for moving the damper are disclosed in my copending application having the title "Kitchen Ventilator and Damper Actuator and Control Therefor" bearing the McGraw-Edison Company identification of SED-6641.

Concerning the particular bearing mounts, each is of a metal plate shaped in a particular manner to provide proper cooperation with the hood structure and with the damper as will now be described. The one end 46 of the bearing plate is flat to fit flush against the inside of the inner wall 22, and a stud 47 welded to the inner wall structure 22 is adapted to fit through an opening 48 in the plate so that a nut 49 can be tightened against the bearing plate for securing the bearing plate in place relative to the hood structure.

The medial portion 52 of the bearing plate is offset slightly from the flat end mounting portion 46 and thus is inwardly spaced from the inner hood wall 22; and the opening 40 previously noted is in this medial portion. The free edge of the inner hood wall 22 is flared outwardly as at 53 and the bearing plate end opposite from the flat mounting end is curled over almost onto itself to form a lip 55; and the lip 55 overlies the flared inner wall end 53. This lip edge cooperation along with the single stud 47 fitting through the mounting end portion opening 48 securely holds the bearing plate in a most economical and expedient manner.

The medial portion 52 of the bearing plate extends across the inlet opening almost between the top wall 20 and the lower wall 21, so that in fact, the air inlet opening is defined in part by the positioned bearing plates. Thus, the clearance shown at 57 (FIG. 3) between the end edge of the damper plate and the bearing plate at flat 52 can be uniform and minimal to reduce air leakage past these components when the damper is closed. This is important since the purpose of the damper as mentioned above is to prevent flow of air through the inlet from the kitchen to the exhaust duct, particularly when the closed damper should serve as an effective fire block. With the subject bearing construction, the degree of tightness allowed in the mounting of the damper is maintained consistent within manufacturing requirements of such equipment and further is yet economical to fabricate and easily install.

It is possible to have both stub shafts and bearing mounts identical to that shown in FIG. 3, where the stub shaft would end up short of the interior hood wall 22. It also is possible to have an opening in the hood walls 22 and 24 for receipt of a longer stub shaft, which would be provided only at one end of the damper, so that the longer shaft would project beyond the hood walls to outside the inlet opening. With this particular mounting arrangement it would be possible to key a lever to the projected stub shaft as a means for opening and closing the damper, where a power actuator similar to that shown in FIG. 1 would likewise be provided but it would be located outside the typical air stream at the hood inlet.

It is thus noted that the particular mounting means are easily fabricated since the same only includes flat thin plates which can be of almost any economical grade structural steel, and further allows for the ready securement of the bearing plates to the hood wall structure itself, and thus the ready installation and/or removal of the damper itself relative to the inlet opening.

What is claimed is:

1. In a kitchen venting system having an exhaust duct and a power fan means therein, the combination of interconnected opposing pairs of side walls defining an air inlet open to the kitchen that communicates through internal passage means with the exhaust duct, a damper, means to pivot the damper to one of the pairs of side walls to move between a closed position across the inlet and an open position removed from the inlet, said damper having end edges spaced apart less than the distance between the one pair of side walls and said pivot means including stub shafts projecting beyond the end edges of the damper, said pivot means further including bearing means to receive and journal the respective stub shafts, each said bearing means being in the form of a flat relatively thin plate having when shaped a first portion with an opening therein for receiving and journalling one of the stub shafts and having a laterally offset end portion, said offset end portions of the plates abutting the one pair of the side walls and maintaining the first portions of the plates at the shaft opening spaced from the one pair of the side walls, means for releasably securing each bearing means plate to the adjacent side walls to allow the ready installation and removal of the damper relative to the side wall, each wall of the one pair of side walls terminating along a free edge generally proximate the inlet, each plate on the end thereof opposite the offset portion being folded over almost on itself to define a lip, and said lip overlying and covering the free edge of the side wall when the bearing means plate is secured to the side wall.

2. A kitchen venting system combination according to claim 1, wherein the bearing means first portions are generally flat and extend almost the full distance to and between the other pair of side walls defining the air inlet, and wherein the end edges of the damper in the damper closed position are closely adjacent but spaced from the bearing means first portions.

* * * * *